United States Patent [19]

Leonard et al.

[11] Patent Number: 4,670,992

[45] Date of Patent: Jun. 9, 1987

[54] PROCESS FOR TREATING WOOD PRODUCTS

[75] Inventors: Robert E. Leonard; William H. Lamansky, both of Oklahoma City, Okla.

[73] Assignee: Kerr-McGee Chemical Corporation, Oklahoma City, Okla.

[21] Appl. No.: 846,224

[22] Filed: Mar. 31, 1986

[51] Int. Cl.[4] ..... F26B 7/00

[52] U.S. Cl. ..... 34/9.5; 34/13.8; 34/16.5

[58] Field of Search ..... 34/9.5, 13.8, 16.5; 252/384

[56] References Cited

U.S. PATENT DOCUMENTS

| | | | |
|---|---|---|---|
| 1,838,291 | 12/1931 | Arnold | 34/16.5 |
| 2,216,775 | 10/1940 | Helson | 34/16.5 |
| 2,860,070 | 11/1958 | McDonald | 34/16.5 |
| 3,995,077 | 11/1976 | Hager | 34/13.8 |
| 4,313,976 | 2/1982 | Leach | 106/18.33 |
| 4,599,192 | 7/1986 | Rose | 514/525 |
| 4,602,011 | 7/1986 | West et al. | 514/576 |

*Primary Examiner*—Albert J. Makay
*Assistant Examiner*—David W. Westphal
*Attorney, Agent, or Firm*—William G. Addison; John P. Ward

[57] ABSTRACT

The invention relates to an improved process for drying and preserving wood products. The improved process comprises the steps of first drying the wood products by submerging them in a naphthalene poor, coal tar based heat transfer medium under conditions of elevated temperature and reduced pressure. The dried wood products then are impregnated with a naphthalene rich, coal tar based wood preservative agent by submerging said dried wood products in said agent under conditions of both elevated temperature and pressure.

6 Claims, 1 Drawing Figure

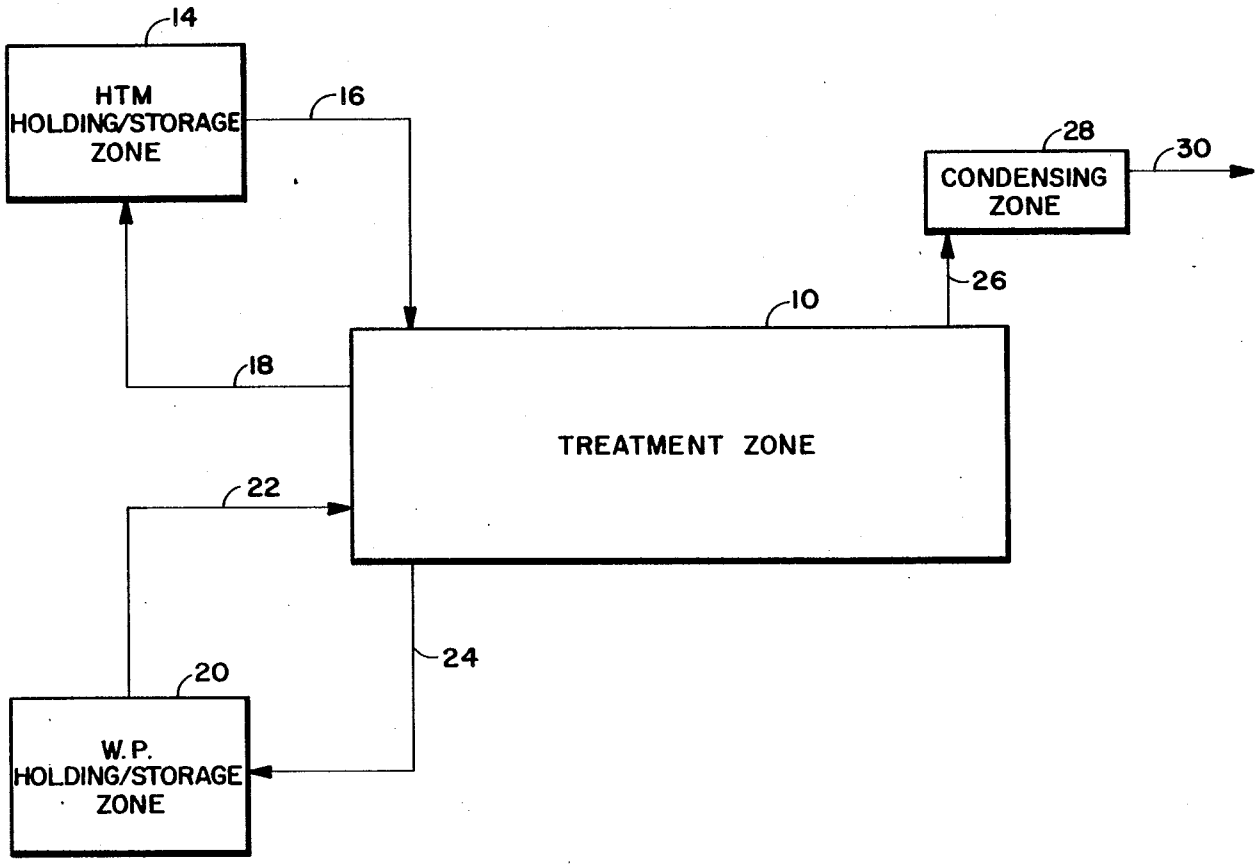
30
28
CONDENSING ZONE
26
10
TREATMENT ZONE
24
16
18
22
14
HTM HOLDING/STORAGE ZONE
20
W.P. HOLDING/STORAGE ZONE

PROCESS FOR TREATING WOOD PRODUCTS

FIELD OF THE INVENTION

The present invention relates to an improved process for preserving wood products. More particularly, the present invention relates to an improved process for drying and treating wood products with preservative agents wherein the drying is carried out employing a naphthalene poor, coal tar based, wood preservative agent as a heat transfer medium.

BACKGROUND OF THE INVENTION

Integrated wood preserving processes comprising the artificial drying of green wood products and the subsequent impregnation of the dried wood products with a preservative agent under pressure are old and well-known. One such known integrated process utilizes a boiling under vacuum step to dry the wood products and a pressure step to thereafter force preservative agent into the cells of the dried wood products. This process has particular applicability to the drying and impregnation of wood products such as bridge ties, mine ties, railroad crossties and switch ties, pilings for both land and water use, utility poles and the like. In this process, coal tar based creosote-coal tar and creosote-petroleum oil mixed solutions containing relatively volatile naphthalene fractions are utilized in both the drying and pressure steps.

In utilizing the above integrated process for drying and impregnating wood products with one of the aforementioned naphthalene rich preservative agents, problems can and do occur. These include, for example, the plugging of process equipment and the contamination of process derived waste waters with naphthalene as a result of the volatile naphthalene fractions in the preservative being stripped from the wood products during the drying step. These problems further are compounded by the fact that in most commercial operations, it is usual practice to recover this naphthalene and return it to the preservative agent storage or supply tanks. Thus, with each succeeding use of the preservative agent from the storage or supply tanks, the same naphthalene not only is being restripped from the preservative agent during each drying phase, but also this naphthalene is building up in concentration in the recycling preservative agent. Such build-up only further contributes to the aforementioned process equipment plugging and waste water contamination problems.

SUMMARY OF THE INVENTION

It now has been discovered that it is possible to substantially minimize or eliminate the above described problems of process equipment plugging, process waste water contamination and naphthalene build-up associated with the above mentioned integrated wood preserving process through the utilization of the improved process of the present invention.

Broadly, the improved process of the present invention comprises the steps of first submerging the wood products to be dried in a suitable treatment vessel in a heat transfer medium, comprising a mixture of a minor portion of a naphthalene rich, coal tar based wood preservative agent and a major portion of a naphthalene poor, coal tar based wood preservative agent. The wood products, submerged in the heat transfer medium then are heated at elevated temperatures and reduced pressures to effect a removal of a portion of the water inherent in the wood products. Following drying, the heat transfer medium is withdrawn from the treatment vessel and replaced with a naphthalene rich, coal tar based wood preservative agent in an amount sufficient to submerge the dried wood products therein. The submerged dried wood products then are heated to and maintained at elevated temperatures and under elevated pressures to impregnate the wood products with the wood preservation agent.

DESCRIPTION OF THE DRAWING

The single FIGURE represents a schematic illustration of the general steps and flow of materials in the process of the present invention.

DETAILED DESCRIPTION OF THE INVENTION

For the following detailed description of the improved process comprising the present invention reference is made to the single FIGURE illustrating the general steps and flow of materials. Referring to this FIGURE, the wood products (not shown) to be subjected to drying and subsequent impregnation are loaded into treatment zone 10, which most usually will consist of at least one vessel commonly referred to in the wood treatment industry as a cylinder or retort. In general, this treatment vessel will be equipped with internal steam coils or other heat exchange means, means for introducing and withdrawing the heat transfer medium and wood preservative agent into and from the vessel and means for applying vacuums and pressures thereto.

Once the wood products are loaded into treatment zone 10, said zone 10 is closed and the heat transfer medium transferred thereto from heat transfer medium (HTM) holding/storage zone 14 by way of conduit 16. Sufficient quantities of heat transfer medium are transferred to treatment zone 10 from HTM holding/storage zone 14 to completely submerge the wood products to be treated.

For purposes of the present invention, the heat transfer medium will comprise a mixture of a minor portion of a naphthalene rich, coal tar based, wood preservative agent and a major portion of a naphthalene poor, coal tar based wood preservative agent. The naphthalene rich preservative agent forming the minor portion of the mixture comprising the heat transfer medium will be at least one fluid material selected from the group consisting of creosote-coal tar mixed solutions and creosote-petroleum oil mixed solutions. Specific, but non-limiting, examples of the fluid material in the above group which can be employed as the naphthalene rich preservative agent in the above described heat transfer medium are those meeting the wood preservative specification as set forth in ASTM designation D391-78 and in the American Wood-Preservative Association (AWPA) standard P3-67.

The naphthalene poor wood preservative agents employed in forming the heat transfer medium of the present invention and constituting the major portion of said medium is a fluid material prepared or derived from the above defined group of naphthalene rich preservative agents. Thus, the naphthalene poor preservative agent will comprise a fluid material selected from the group consisting of naphthalene poor creosote-coal tar mixed solution and naphthalene poor creosote-petroleum oil mixed solution.

In general, the naphthalene poor preservative agents employed in the present invention are formed, in situ, during the drying of wood products utilizing one of the above described naphthalene rich preservative agents as the heat transfer medium. Under the elevated temperatures and reduced pressures employed in the drying step, a portion of the relatively volatile naphthalene fraction in the preservative agent is stripped therefrom by the action of the moisture in the wood products. At the end of the drying step, the remaining wood preservative agent is poor in naphthalene. It is this naphthalene poor wood preservative agent which then is subsequently used to prepare the heat transfer medium employed in this invention.

As discussed hereinabove, the heat transfer medium useful in the present invention will comprise only a minor portion of the naphthalene rich preservative agent. As used throughout this description and appended claims, the term "minor portion", means the incremental amount of naphthalene rich preservative agent which is required as make-up to account for the mechanical fluid losses incurred in the process. In general, such incremental amount will range from about 0.5 to about 2.0 percent by volume of the total volume of heat transfer medium employed in treatment zone 10. However, depending upon the extent of mechanical fluid loss this incremental amount can be either less or greater than the percentages given.

The drying of the wood products contained within treatment zone 10 is carried out by heating the submerged wood products to temperature levels which do not exceed the maximum temperatures recommended for the particular species of wood in the wood products undergoing treatment. Also, the drying will be carried out at reduced pressure levels sufficient to allow vaporization of the moisture inherent in the wood products at the temperatures employed. In general, temperatures ranging from about 175° F. (79° C.) to about 225° F. (107° C.) and reduced pressures ranging from about 20 to about 25 inches of mercury will be employed. For a more specific description of particular temperatures and vacuums which can be used for drying particular wood species, reference is made to ASTM designation D1760-83, the teachings of which are incorporated herein by reference in their entirety.

During the drying step of the process of this invention, the moisture inherent in the wood products undergoes vaporization and is released from the wood products in the form of steam. This steam is continuously removed from treatment zone 10 by conduit 26 through which it is conveyed to condensing zone 28. Within condensing zone 28 the steam is converted to water which is withdrawn from said condensing zone 28 through conduit 30 for subsequent treatment and disposal (not shown).

Following completion of the drying of the wood products the heat transfer medium is withdrawn from treatment zone 10 and returned to HTM holding/storage zone 14 by way of conduit 18. A naphthalene rich wood preservative agent then is introduced into treatment zone 10 from wood preservative (W.P.) holding/storage zone 20 through conduit 22. The naphthalene rich wood preservatives agent can comprise any of the naphthalene rich preservative described hereinabove. Once again, a sufficient amount of this preservative agent will be introduced into treatment zone 10 to completely submerge the dried wood products contained therein.

Once the naphthalene rich preservative agent has been introduced into treatment zone 10, the temperature within treatment zone 10 is raised to a value averaging not less than about 175° F. (79° C.) and not greater than about 225° F. (107° C.). Also, in order to force the preservative agent into the open cells of the dried wood products, a pressure will be applied to treatment zone 10. Useful pressures will range about 115 pounds per square inch gauge (psig) to about 250 psig. The precise temperatures and pressures used in this impregnation step of the present process will depend upon the particular species of wood undergoing treatment. However, in this regard, reference is made to ASTM designation D1760-83. Therein, guidelines are provided relating to impregnation temperatures and pressures to be used for various wood species and which guidelines are incorporated herein by reference in their entirety.

Following completion of the impregnation of the dried wood products with the naphthalene rich preservative agent, the agent is withdrawn from treatment zone 10 and returned to W.P. holding/storage zone 20 through conduit 24. The impregnated wood products then can be subjected to a final vacuum to reduce any residual preservative agent on the surface thereof and then are removed from treatment zone 10.

The improved process of the present invention has been described in terms of the use of a single cylinder or retort in treatment zone 10 for both drying and impregnating wood products. However, as disclosed hereinabove, more than one cylinder or retort can be employed at one time in treatment zone 10. For example, treatment zone 10 can comprise two cylinders or retorts where in one cylinder wood products are being dried while in the other cylinder, previously dried wood products are being impregnated. Each cylinder will be arranged in fluid communication with each of HTM holding/storage zone 14 and W.P. holding/storage zone 20 by appropriate conduit and flow controlling means. Such arrangement will allow for the transfer of the heat transfer medium and wood preservative agent between each of the cylinders as well as between each of the cylinders and HTM holding/storage zone 14 and W.P. holding/storage zone 20.

While the present invention has been described in terms of all of its known embodiments, it is to be understood that changes and modifications can be made without departing from the spirit and scope thereof.

What is claimed is:

1. An improved process for drying and preserving wood products comprising:

submerging said wood products in a heat transfer medium comprising a mixture of a minor portion of naphthalene rich, coal tar based, wood preservative agent selected from the group consisting of creosote-coal tar mixed solutions and creosote-petroleum mixed solutions and a major portion of a naphthalene poor, coal tar based, wood preservative agent prepared from the group of naphthalene rich preservative agent defined above, said wood products being submerged in said heat transfer medium in a treatment zone;

heating and maintaining said submerged wood products at elevated temperatures and under reduced pressures to remove a portion of water inherent in said wood products and provide dried wood products;

withdrawing said heat transfer medium from said treatment zone and introducing into said treatment zone a naphthalene rich preservative agent selected from the group defined above in an amount sufficient to submerge the dried wood products therein; and heating and maintaining said submerged dried wood products at elevated temperatures and under elevated pressures to impregnate said dried wood products with said naphthalene rich preservative agent.

2. The improved process of claim 1 wherein said naphthalene poor, coal tar based, wood preservative agent in said heat transfer medium is prepared by heating wood products submerged in a naphthalene rich, coal tar based, wood preservative agent under reduced pressure to remove the moisture inherent therein in the form of steam, said steam effectively stripping the naphthalene from said naphthalene rich wood preservative agent.

3. The improved process of claim 1 wherein said minor portion of said naphthalene rich, coal tar based, wood preservative agent in said heat transfer medium ranges from about 0.5 to about 2.0 percent by volume of the total volume of said heat transfer agent in said treatment zone.

4. The improved process of claim 1 wherein the submerged wood products in the treatment zone are heated to and maintained at temperatures ranging from about 175° F. to about 225° F. and under reduced pressures ranging from about 20 to about 25 inches of mercury.

5. The improvement of claim 1 wherein the submerged dried wood products in the treatment zone are heated to and maintained at temperatures ranging from about 175° F. to about 225° F. and under elevated pressures ranging from about 115 psig to about 250 psig.

6. The improvement of claim 1 wherein said heat transfer medium is comprised of a minor portion of a naphthalene rich creosote-coal tar mixed solution and a major portion of naphthalene poor creosote-coal tar mixed solution.

* * * * *